United States Patent [19]

Chang et al.

[11] Patent Number: 4,613,368

[45] Date of Patent: Sep. 23, 1986

[54] TRI-NICKEL ALUMINIDE COMPOSITIONS ALLOYED TO OVERCOME HOT-SHORT PHENOMENA

[75] Inventors: Keh-Minn Chang, Schenectady; Shyh-Chin Huang, Latham; Alan I. Taub, Schenectady, all of N.Y.

[73] Assignee: General Electric Company, Schenectady, N.Y.

[21] Appl. No.: 783,585

[22] Filed: Oct. 3, 1985

[51] Int. Cl.[4] ..... B22F 3/00

[52] U.S. Cl. ..... 75/246; 75/0.5 C; 75/82; 148/11.5 A; 148/11.5 N; 148/11.5 P; 148/126.1; 148/133; 148/429; 420/459; 420/460; 420/590; 419/30; 419/38; 419/49; 419/62; 419/66; 419/68

[58] Field of Search ..... 75/246, 0.5 C, 82; 148/11.5 A, 11.5 N, 11.5 P, 126.1, 133, 429; 420/459, 460, 590; 419/30, 38, 49, 62, 66, 68

[56] References Cited

U.S. PATENT DOCUMENTS

| | | | |
|---|---|---|---|
| 2,755,184 | 7/1956 | Turner et al. | 420/460 |
| 3,653,976 | 4/1972 | Miller et al. | 420/460 |
| 3,902,900 | 9/1975 | Restall et al. | 420/449 |
| 3,922,168 | 11/1975 | Restall et al. | 420/448 |
| 4,379,720 | 4/1983 | Ray et al. | 420/460 |
| 4,478,791 | 10/1984 | Huang et al. | 420/449 |

OTHER PUBLICATIONS

A. I. Taub, S. C. Huang & K. M. Chang, "High Temperature Ductility Minimum in Rapidly Solidified $Ni_3Al$-B", Mat. Res. Soc. Symp. Proc., vol. 39 (1985), Materials Research Society.

C. T. Liu & C. C. Koch, "Development of Ductile Polycrystalline $Ni_3Al$ For High-Temperature Applications", Technical Aspects of Critical Materials Use by the Steel Industry, NBSIR 83-2679-2, vol. IIB (Jun. 1983), Center for Materials Science, U.S. Dept. of Commerce, Nat'l. Bureau of Standards.

*Primary Examiner*—Stephen J. Lechert, Jr.

*Attorney, Agent, or Firm*—Paul E. Rochford; James C. Davis, Jr.; Paul R. Webb, II

[57] ABSTRACT

A tri-nickel aluminide base composition is provided which has good ductility at all temperatures. The composition has a relatively high concentration of cobalt substituent and is doped by boron. It also has minor concentrations of at least two other substituent metals selected from the group consisting of niobium, hafnium, vanadium, molybdenum and zirconium.

9 Claims, 5 Drawing Figures

TRI-NICKEL ALUMINIDE COMPOSITIONS ALLOYED TO OVERCOME HOT-SHORT PHENOMENA

CROSS REFERENCE TO RELATED APPLICATION

Applicants draw attention to copending application Ser. No. 783,582, filed 10-3-85 assigned to the same assignee as the subject application. This copending application is incorporated herein by reference.

BACKGROUND OF THE INVENTION

The present invention relates generally to compositions having a nickel aluminide base and their alloying to improve their properties. More specifically, it relates to tri-nickel aluminide base materials which may be alloyed to overcome a hot-short problem of such materials when formed into useful articles.

It is known that unmodified polycrystalline tri-nickel aluminide castings exhibit properties of extreme brittleness, low strength and poor ductility at room temperature.

The single crystal tri-nickel aluminide in certain orientations does display a favorable combination of properties at room temperature including significant ductility. However, the polycrystalline material which is conventionally formed by known processes does not display the desirable properties of the single crystal material and, although potentially useful as a high temperature structural material, has not found extensive use in this application because of the poor properties of the material at room temperature.

The inventors hereof have discovered how to overcome the shortcomings of the polycrystalline tri-nickel aluminide at ambient temperatures and have disclosed the manner and means of adding significant ductility and strength to room temperature tri-nickel aluminide in several copending applications discussed below.

It is known from these copending applications that rapidly solidified boron doped tri-nickel aluminide has good physical properties at room temperatures and at temperatures up to about 1100° F. (600° C.) and could be employed, for example, in jet engines as component parts at temperatures up to about 600° C.

Alloys having a tri-nickel aluminide base are among the group of alloys known as heat-resisting alloys or superalloys. Superalloys are intended for very high temperature service where relatively high stresses such as tensile, thermal, vibratory and shock are encountered and where oxidation resistance is frequently required.

Accordingly, what has been sought in the field of superalloys is an alloy composition which displays favorable stress resistant properties not only at the elevated temperatures above 1000° C. at which it may be used, as for example in a jet engine, but also a practical and desirable and useful set of properties at the lower temperatures of room temperature to which the engine is subjected in storage and at intermediate temperatures to which the engine is subjected during warm-up operations.

Significant efforts have been made toward producing a tri-nickel aluminide and similar superalloys which may be useful over such a wide range of temperature and adapted to withstand the stress to which the articles made from the material may be subjected in normal operations over such a wide range of temperatures. The problems of low strength and of excessive low ductility at room temperature have been largely solved.

For example, U.S. Pat. No. 4,478,791, assigned to the same assignee as the subject application, teaches a method by which a significant measure of ductility can be imparted to a tri-nickel aluminide base metal at room temperature to overcome the brittleness of this material.

Also, copending applications of the same inventors as the subject application, Ser. Nos. 647,326 647,327; 647,328; 646,877 and 646,879 filed Sept. 4, 1984 teach methods by which the composition and methods of U.S. Pat. No. 4,478,791 may be further improved. These applications are incorporated herein by reference. These and similar inventions have essentially solved the problem of according a tri-nickel aluminide a moderate degree of strength and ductility at lower temperatures such as room temperature.

Also, there is extensive other literature dealing with tri-nickel aluminide base compositions. For the unmodified binary intermetallic, there are many reports in the literature of a strong dependence of strength and hardness on compositional deviations from stoichiometry. E. M. Grala in "Mechanical Properties of Intermetallic Compounds", Ed. J. H. Westbrook, John Wiley, New York (1960) p. 358, found a significant improvement in the room temperature yield and tensile strength in going from the stoichiometric compound to an aluminum-rich alloy. Using hot hardness testing on a wider range of aluminum compositions, Guard and Westbrook found that at low homologous temperatures, the hardness reached a minimum near the stoichiometric composition, while at high homologous temperature the hardness peaked at the 3:1 Ni:Al ratio. TMS-AIME Trans. 215 (1959) 807. Compression tests conducted by Lopez and Hancock confirmed these trends and also showed that the effect is much stronger for Al-rich deviations than for Ni-rich deviations from stoichiometry. Phys. Stat. Sol. A2 (1970) 469. A review by Rawlings and Staton-Bevan concluded that in comparison with Ni-rich stoichiometric deviations, Al-rich deviations increase not only the ambient temperature flow stress to a greater extent, but also that the yield stress-temperature gradient is greater. J. Mat. Sci. 10 (1975) 505. Extensive studies by Aoki and Izumi report similar trends. Phys. Stat. Sol. A32 (1975) 657 and Phys. Stat. Sol. A38 (1976) 587. Similar studies by Noguchi, Oya and Suzuka also reported similar trends. Met. Trans. 12A (1981) 1647.

More recently, an article by C. T. Liu, C. L. White, C. C. Koch and E. H. Lee appearing in the "Proceedings of the Electrochemical Society on High Temperature Materials", ed. Marvin Cubicciotti, Vol. 83-7, Electrochemical Society, Inc. (1983) p. 32, discloses that the boron induced ductilization of the same alloy system is successful only for aluminum lean $Ni_3Al$.

It has been discovered that boron doped tri-nickel aluminide displays low ductility or a hot-short in a temperature over 600° C. and particularly from about 600° C. to about 800° C. and even up to 1000° C. A recent paper by the inventors hereof describes this phenomena. See Mat. Res. Soc. Symp. Proc. Vol. 39, 1985, 22, Materials Research Society, a copy of which is submitted herewith and the text of which is incorporated herein by reference.

However, to date there has been no report in the patent or other literature of a solution to the hot-short problem for the tri-nickel aluminide base alloys.

The subject application presents a further improvement in the nickel aluminide to which significant increased ductilization has been imparted and particularly improvements in the strength and ductility of tri-nickel aluminide base compositions in the temperature range above about 600° C. where the hot-short condition has been found to occur.

It should be emphasized that materials which exhibit the hot-short condition are very valuable and useful in applications below about 600° C. and in fact below 500° C. 600° C. is about 1137° F. There are many applications for strong oxidation resistant alloys at temperature of 1100° F. and below. The tri-nickel aluminide alloys which have appreciable ductility and good strength at room temperatures and which have oxidation resistance and good strength and ductility at temperatures up to about 1100° F. are highly valuable for numerous structural applications in such high temperature environments.

BRIEF SUMMARY OF THE INVENTION

It is accordingly one object of the present invention to provide a method of improving the properties of articles adapted to use in structural parts at room temperature as well as at a full range of higher temperatures including the temperature at which tri-nickel aluminide displays hot-short phenomena.

Another object is to provide an article suitable for withstanding significant degrees of stress and for providing appreciable ductility at room temperature as well as at a full range of elevated temperatures.

Another object is to provide a consolidated material which can be formed into useful parts having the combination of properties of significant strength and ductility at room temperature and at a full range of elevated temperatures.

Another object is to provide a consolidated material which has a good combination of strength and ductility in the temperature range at which tri-nickel aluminide displays hot-short phenomena.

Another object is to provide parts consolidated from powder which have a set of properties useful in applications such as jet engines and which may be subjected to a variety of forms of stress.

Other objects will be in part apparent and in part set forth in the description which follows.

In one of its broader aspects an object of the present invention may be achieved by providing a melt having a tri-nickel aluminide base and containing a significant concentration of cobalt, a relatively small percentage of boron and containing a variety of additives other than the nickel and aluminum according to the following expression:

$$[Ni_{1-x-y}Co_x(Al_{1-u-v}Q_uR_v)_y]_{100-a-b}M_aB_b$$

wherein:

Q is at least one optional macroalloying element selected from the group consisting of silicon, niobium, vanadium, tantalum, and titanium; and u is the sum of the concentrations in which the macroalloying elements are present, R is at least one microalloying element selected from the group consisting of niobium, hafnium, vanadium, magnesium, manganese, molybdenum and zirconium; and v is the sum of the concentrations of all of the microalloying elements present with the proviso that if niobium or vanadium is present in a concentration value in excess of 0.080 it is present as a macroalloying element, M is at least one optional fungible alloying element selected from the group consisting of iron and chromium; and the quantity, a, is the sum of the concentration between 0.0 and 15 atomic percent in which the fungible alloying elements are present.

setting the concentration of the ingredients of the above expression at the following approximate values for the above expression as follows:

| Ingredient | Concentration | Value |
|---|---|---|
| nickel | 1-x-y | 0.555–0.72 |
| cobalt | x | 0.05–0.20 |
| aluminum | 1-u-v | 0.52–0.98 |
| at least one microalloying element | v | 0.02–0.08 |
| at least one optional macroalloying element | u | 0.0–0.40 |
| the combination of aluminum and its substituents | y | 0.23–0.245 |

said optional macroalloying element, Q, being selected from the group and concentrations as follows:

| Element | Concentration component of u |
|---|---|
| silicon | 0–0.4 |
| niobium | 0–0.28 |
| vanadium | 0–0.2 |
| tantalum | 0–0.2 |
| titanium | 0–0.2 |

said aluminide base alloy containing boron, B, in an amount, b, between 0.15 and 0.65 atomic percent.

The melt is then atomized by inert gas atomization. The melt is rapidly solidified to powder during the atomization. The material is then consolidated. The consolidation may be by hot isostatic pressing at a temperature of about 1150° C. and at about 15 ksi for about two hours. Alternatively it may be by spray forming or by plasma deposition.

The consolidated material displays appreciable strength and ductility in the temperature range in which tri-nickel aluminide base alloys display hot-short properties.

Although the melt referred to above should ideally consist only of the atoms of the intermetallic tri-nickel aluminum phase and according to the above expressions and ingredient and concentrations, it is recognized that occasionally and inevitably other atoms of one or more incidental impurity atoms may be present in the melt.

As used herein the expression boron doped tri-nickel aluminide base composition and equivalent terms refers to a tri-nickel aluminide which contains impurities which are conventionally found in nickel aluminide compositions. Such a composition may include as well alloying elements and/or substituents, other than those which are explicitly prescribed and discussed above, which do not detract from the unique set of favorable properties which are achieved through practice of the present invention.

BRIEF DESCRIPTION OF THE DRAWINGS

The understanding of the invention will be aided, in the description which follows, by reference to the accompanying drawings in which.

DETAILED DESCRIPTION OF THE INVENTION

Figure 1:
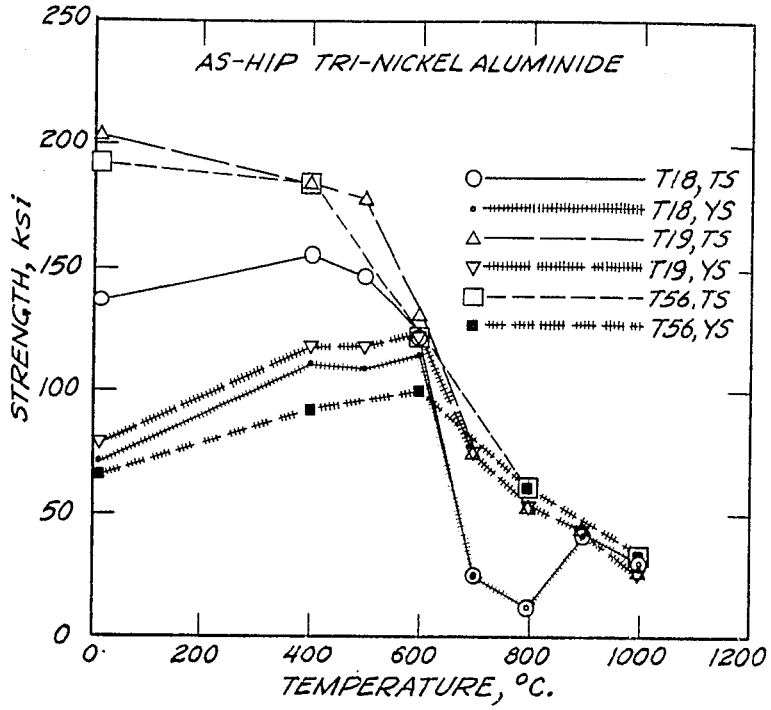
FIG. 1 is a graph in which strength in ksi is plotted against temperature for a number of compositions.

In the case of the superalloy system $Ni_3Al$ or the tri-nickel aluminide base superalloy, the ingredient or constituent metals are nickel and aluminum. The metals are present in the approximate stoichiometric atomic ratio of 3 nickel atoms for each aluminum atom in this system.

Metals which take the place of the nickel or aluminum constituents in the crystal structure of the system are designated as substituent metals.

By a substituent metal is meant a metal which takes the place of and in this way is substituted for another and different ingredient metal, where the other ingredient metal is part of a desirable combination of ingredient metals, and which ingredient metals form the essential ingredients or constituents of an alloy system.

Tri-nickel aluminide is found in the nickel-aluminum binary system, and as the gamma prime phase of conventional gamma/gamma prime nickel-base superalloys. Tri-nickel aluminide has high hardness and is stable and resistant to oxidation and corrosion at elevated temperatures which makes it attractive as a potential structural material.

Nickel aluminide, which has a face centered cubic (FCC) crystal structure of the $Cu_3Al$ type ($Ll_2$ in the Stukturbericht designation which is the designation used herein and in the appended claims) with a lattice parameter $a_o=3.589$ at 75 at. % Ni and melts in the range of from about 1385° to 1395° C., is formed from aluminum and nickel which have melting points of 660° and 1453° C., respectively. Although frequently referred to as $Ni_3Al$, tri-nickel aluminide is an intermetallic phase and not a compound as it exists over a range of compositions as a function of temperature, e.g., about 72.5 to 77 at. % Ni (85.1 to 87.8 wt. %) at 600° C.

Polycrystalline $Ni_3Al$ is quite brittle and shatters under stress as applied in efforts to form the material into useful objects or to use such an article.

It was discovered that the inclusion of boron in the rapidly cooled and solidified alloy system can impart desirable ambient temperature ductility to the rapidly solidified alloy as taught in U.S. Pat. No. 4,478,791.

It has been discovered that certain metals can be beneficially substituted in part for the constituent metal nickel. This substituted metal is designated and known herein as a substituent metal, i.e. as a nickel substituent in the $Ni_3Al$ structure or an aluminum substituent. The beneficial incorporation of certain substituent metals in tri-nickel aluminide to form tri-nickel aluminide base compositions is disclosed and described in the copending applications filed Sept. 4, 1984 and referenced above.

A substituent metal which substitutes in the $Ni_3Al$ at least partially for both nickel and aluminum is designated herein as a fungible substituent or fungible alloying element. A composition which contains iron as a fungible substituent is disclosed in copending application Ser. No. 647,328 filed Sept. 4, 1984. For this invention iron and chromium are optional fungible substituents and either may be included at a concentration of between 0.0 and 15 atomic percent, and preferably at between 0 and 10 atomic percent.

A composition containing cobalt as a substituent for nickel is disclosed in copending application Ser. No. 647,326 filed Sept. 4, 1984 and referenced above.

The rapidly solidified alloy compositions of the prior invention and also of the present invention must also contain boron as a tertiary ingredient as taught herein and as also taught in U.S. Pat. No. 4,478,791. A preferred range for the boron dopant additive for this invention is between 0.15 and 0.65 atomic percent and most preferably about 0.25 atomic percent.

The composition which is formed must have a preselected intermetallic phase having a crystal structure of the $Ll_2$ type and must have been formed by cooling a melt at a cooling rate of at least about $10^3$° C. per second to form a solid body the principal phase of which is of the $Ll_2$ type crystal structure in either its ordered or disordered state.

The alloys prepared according to the teachings of U.S. Pat. No. 4,478,791 as rapidly solidified cast ribbons have been found to have a highly desirable combination of properties, and particularly of strength and ductility. The ductility achieved through rapid solidification is particularly significant in comparison to the zero level of ductility of previous boron free samples of $Ni_3Al$ of the prior art.

However, it has been found that annealing of the cast ribbons led to a loss of ductility. An annealing embrittlement has been observed. It is described in copending application Ser. No. 783,718, filed 10/3/85 which application incorporated herein by reference. Such annealing embrittlement leads to a room temperature or low temperature brittleness.

A significant advance in overcoming the annealing embrittlement is achieved by preparing a specimen of tri-nickel aluminide base alloy through a combination of atomization and consolidation techniques. This is also described in the copending application Ser. No. 783,718, filed 10/3/85.

It has been found that tri-nickel aluminide base compositions are also su.bject to an intermediate temperature ductility minimum. A minimum has been found to occur in a temperature range of about 600° C. to about 800° C. and up to 1000° C.

It has been found that the problem of the intermediate temperature ductility minimum can be overcome by a combination of process steps, including mechanically working a consolidated specimen, as taught in copending application Ser. No. 783,582, filed 10/3/85. The text of this copending application is incorporated herein by reference.

Surprisingly it has now been found that it is possible to form alloyed tri-nickel aluminide base compositions by rapid solidification atomization and that such alloyed compositions do not have deleteriously low ductility at any temperature. Also it has been found that these alloyed tri-nickel aluminides do not require any mechanical working or other processing. Accordingly it is found that by the novel alloying of the subject invention, as set out in the specification and claims below, that the material does not have an unacceptably low ductility at room temperature or 600° C. or at 800° C. or at any other intermediate temperature below its prospective use temperature of over 1000° C.

In order to prepare a composition of the present invention the alloy melt of the designated composition is atomized. A certain fraction may be selected from the powder based on particle size. For example the fraction having particle sizes less than −100 mesh may be selected.

Following the atomization and sifting the powder which is selected is consolidated into a solid body. Such consolidation may be by hot isostatic pressing (HIPping). No mechanical or thermal treatments are accorded to the hot isostatic pressed sample in order to render it free of the inadequate ductility normally found in boron doped tri-nickel aluminides at intermediate temperatures of 600 to 800° C. This result is quite unique.

Prior to this invention compositions which were prepared as rapidly solidified materials either in the form of ribbon or in the form of powder, and which could then be consolidated by hot isostatic pressing to produce a dense material, were found to have significant ductility at ambient temperatures. This accomplishment is discussed above in relation to other applications which are copending with the subject application. These as-HIPped materials were found nevertheless to exhibit a ductility minimum or "hot short" condition at intermediate temperatures of 600° to 800° C. However, it is deemed desirable to be able to work tri-nickel aluminide-base alloys at such intermediate temperatures. To permit such forming, an alloy with enhanced ductility at intermediate temperatures was sought after so that engine components for jet engines and the like could be manufactured from an "as-HIPped" sample.

This invention makes possible for the first time a means for producing an as-HIPped boron doped tri-nickel aluminide sample which is not characterized by a hot-short condition.

The invention and the advantages made possible as a result of the invention will be made clearer by consideration of the following examples.

EXAMPLE 1

A melt was prepared to contain 24.77 atomic percent aluminum and 0.93 atomic percent boron with a balance of nickel. The melt and compositions prepared from it were identified as T-18. The percentages given are nominal percentages which means that the percentage is based on the weight of ingredients added to form the alloy rather than on analysis made of the ingredient content of the alloy after it was formed.

The melt was atomized in an inert gas atmosphere to rapidly solidify the powder particles into a crystal structure having the $Ll_2$ type configuration.

The atomization was carried out in accordance with one or more of the methods taught in copending applications for patent of S. A. Miller, Ser Nos. 584,687; 584,688; 584,689; 584,690 and 584,691 filed Feb. 28, 1984 and assigned to the assignee of this application. The text of these applications are incorporated herein by reference. Other and conventional atomization processes may be employed to form rapidly solidified powder to be consolidated. The powder was screened and the fraction having particle sizes of approximately −100 mesh or smaller were selected.

The selected powder was sealed into a metal container and HIPped. The HIP process is a Hot Isostatic Pressing process. In this example the selected powder specimens were HIPped at between 1140° and 1165° C. for two hours under 15 ksi pressure. A metallographic examination of the as-HIPped sample revealed that the alloy had a single phase structure as a result of the HIPping.

Figure 2:
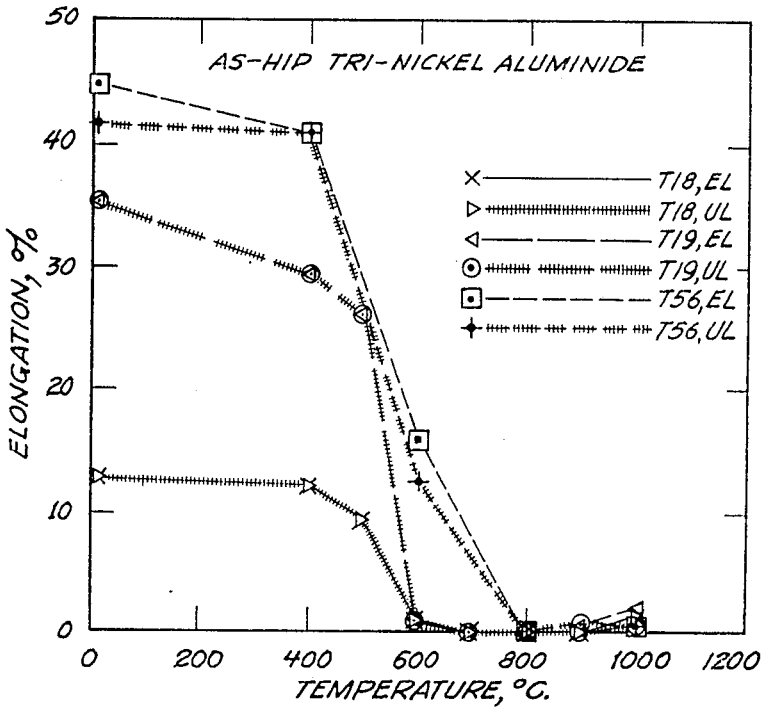
FIG. 2 is a graph in which elongation in percent is plotted against temperature for some of the same compositions.

Tensile measurements were made at room temperature on the resultant sample. A yield strength value of 71.8, and a tensile strength value of 138.3 were observed. Uniform elongation was 13.0 percent and final elongation was 13.0 percent. In FIGS. 1 and 2, graphs are provided displaying the properties determined from the tests of this sample T-18.

The intermediate temperature ductility was evaluated at 800° C. by tensile tests. The result of this test showed that a tensile strength of 12.3 ksi was found. The uniform elongation was 0.0 and the final elongation was 0.0.

EXAMPLE 2

The procedure employed in Example 1 was repeated. In this example, the test composition employed is that listed in Table I as T-19. Tensile and elongation data obtained from room temperature testing are as listed in Table II. As is evident from the results listed in Table II, the ductility is almost three-fold higher than that of the sample of Example 1.

The properties of this composition over a range of temperatures is given in FIGS. 1 and 2. As is evident from the Figures the ductility of the composition at 800° C. is inadequate. In fact it is essentially zero.

EXAMPLE 3

The procedure of Example 1 was again repeated but in this case the concentration, x, of aluminum in the composition according to the expression:

$$(Ni_{1-x}Al_x)_{99.25}B_{.15}$$

was at 0.24 whereas in the composition of Examples 1 and 2 the concentration, x, of aluminum were both at about the 0.25 level. The concentrations of the contents of the compositions of the examples of this application are nominal concentrations in that the concentrations listed are the concentrations of the materials added to form the respective melts. The concentrations are believed to be accurate but are not based on analysis done on the compositions of the samples tested.

The melt, identified as T-56, was atomized and the atomized powder was HIPped as also described in Example 1 and the HIPped sample was tested.

Room temperature test results are listed in Table II.

Physical properties were tested over a range of temperatures and the results are also plotted in FIGS. 1 and 2.

EXAMPLES 4–11

The procedure set forth in Example 1 was repeated on the preparation of eight additional alloys. A nominal ingredient concentration of these alloys is set forth in Table I below.

It is evident from Table I that a wide variety of compositions of ingredients were employed in the samples prepared. Nickel and aluminum were present as the constituent elements in each sample. However the various samples contained different concentrations of boron. The samples also contained a variety of other additive elements as substituents for aluminum. These substituents included silicon, niobium, hafnium, vanadium, molybdenum and zirconum.

Cobalt is a substituent for nickel and the nickel concentration was decreased for samples to which cobalt was added. In the last column of the Table under [Al] there is listed the approximate total atomic percentage of those elements which are thought to occupy the aluminum site of the crystal lattice as substituents for aluminum. This is calculated as the total percentage of Al and its substituents with respect to the alloy composition without boron or a fungible alloying additive.

For each of the samples T-18 through T-144 of the Examples 1 through 11 the melt was atomized as described in Example 1 and the powder formed was collected. The collected powder was then HIPped, also as described in Example 1 above. Property measurements were made and some of these are set out in Tables II and III below and in the discussion which follows. Also some values are plotted in FIGS. 3, 4 and 5 and also discussed below.

TABLE 1

Tri-nickel aluminide base alloys prepared by powder metallurgy
P/M Ni3Al-B Alloys
Composition, at. %

| Example | Alloy | Ni | Co | Al | Si | Nb | Hf | V | Mo | Zr | B | [Al]* |
|---|---|---|---|---|---|---|---|---|---|---|---|---|
| 1 | T-18 | bal. | — | 24.77 | — | — | — | — | — | — | 0.93 | 25.00 |
| 2 | T-19 | bal. | 9.91 | 24.75 | — | — | — | — | — | — | 0.98 | 25.00 |
| 3 | T-56 | bal. | — | 23.82 | — | — | — | — | — | — | 0.75 | 24.00 |
| 4 | T-57 | bal. | 9.93 | 23.82 | — | — | — | — | — | — | 0.75 | 24.00 |
| 5 | T-70 | bal. | 10.01 | 18.54 | 5.02 | 0.28 | — | — | — | 0.03 | 0.24 | 23.92 |
| 6 | T-117 | bal. | 10.00 | 14.25 | 9.13 | — | — | 0.50 | — | — | 0.24 | 23.93 |
| 7 | T-111 | bal. | 10.08 | 22.97 | — | 0.28 | — | — | 0.54 | 0.03 | 0.24 | 23.87 |
| 8 | T-114 | bal. | 10.94 | 22.88 | — | 0.28 | — | — | 0.54 | 0.03 | 0.71 | 23.89 |
| 9 | T-113 | bal. | 10.48 | 19.90 | — | 3.47 | — | — | 0.56 | 0.03 | 0.25 | 24.02 |
| 10 | T-143 | bal. | — | 23.10 | — | — | 0.51 | — | — | — | 0.10 | 23.63 |
| 11 | T-144 | bal. | 10.24 | 22.35 | — | 0.28 | 0.51 | — | 0.55 | 0.03 | 0.24 | 23.78 |

*The values given in the column labelled Al are the values of concentration of aluminum and its substituents. In the expression below and in the claims this value when divided by 100 is the value of, y, in the expression set out and discussed above.

For each Example 1 through 11 the collected powder was HIPped at temperatures between 1140° C. and 1165° C. for two hours at 15 ksi of pressure.

Each HIPped sample was metallographically examined and found to contain a single phase structure. Tests were performed on the single phase structures at room temperature and at 800° C. In Table II the results of the tests at room temperature are given for each of the samples including those of Examples 1, 2 and 3.

TABLE II

Tensile and Elongation Data
for boron doped tri-nickel
aluminide base alloys
at room temperature

| Example | Alloy | Temp. (C.) | Y.S. (ksi) | T.S. (ksi) | Uniform Elongation U.L. (%) | Final Elongation E.L. (%) |
|---|---|---|---|---|---|---|
| 1 | T-18 | 20 | 71.8 | 138.3 | 13.0 | 13.0 |
| 2 | T-19 | 20 | 79.0 | 203.2 | 35.3 | 35.3 |
| 3 | T-56 | 20 | 66.1 | 192.7 | 41.6 | 44.6 |
| 4 | T-57 | 20 | 61.7 | 154.1 | 28.5 | 28.5 |
| 5 | T-70 | 20 | 64.1 | 207.7 | 37.3 | 39.4 |
| 6 | T-117 | 20 | 74.7 | 203.8 | 40.7 | 40.7 |
| 7 | T-111 | 20 | 49.6 | 195.4 | 42.9 | 45.5 |
| 8 | T-114 | 20 | 68.9 | 218.6 | 32.6 | 32.6 |
| 9 | T-113 | 20 | 78.6 | 214.6 | 35.2 | 35.2 |
| 10 | T-143 | 20 | 43.5 | 96.5 | 9.8 | 9.8 |
| 11 | T-144 | 20 | 71.1 | 202.5 | 40.9 | 45.9 |

In Table III there are listed the results of the tests made at 800° C. on each of the Examples 1 through 11.

The following observations concerning the data contained in the Tables is offered herewith.

The data listed in Table III are the tensile test results of Examples 1 through 11 at 800° C. Table III includes results of tests of the eleven samples in the as-HIPped condition. Among the eleven samples only four of them, specifically T-117 (Example 6), T-111 (Example 7), T-113 (Example 9), and T-144 (Example 11), show some plastic deformation after yielding.

Furthermore, two out of these four and specifically T-144 (Example 11) and T-111 (Example 7) demonstrate a more enhanced ductility. The more enhanced ductility is characterized in that "necking" is observed with a final or total elongation (EL) greater than the uniform elongation (UL). In the case of T-144 (Example 11) the uniform elongation was found to be 1.0% and the final elongation was found to be 3.0%. In case of the sample T-111 (Example 7) the uniform elongation was found to be 1.3% and the final elongation was found to be 2.1% as is evident from Table III.

TABLE III

Tensile Data at 800° C. for boron doped
tri-nickel aluminide base alloys

| Example | Alloy | Temp. (C.) | Y.S. (ksi) | T.S. (ksi) | Uniform Elongation (U.L.) (%) | Final Elongation (E.L.) (%) |
|---|---|---|---|---|---|---|
| 1 | T-18 | 800 | — | 12.3 | 0.0 | 0.0 |
| 2 | T-19 | 800 | — | 75.0 | 0.0 | 0.0 |
| 3 | T-56 | 800 | — | 61.0 | 0.0 | 0.0 |
| 4 | T-57 | 800 | — | 45.6 | 0.0 | 0.0 |
| 5 | T-70 | 800 | — | 61.8 | 0.0 | 0.0 |
| 6 | T-117 | 800 | 78.3 | 82.7 | 0.6 | 0.6 |
| 7 | T-111 | 800 | 79.3 | 86.7 | 1.3 | 2.1 |
| 8 | T-114 | 800 | — | 60.4 | 0.0 | 0.0 |
| 9 | T-113 | 800 | 97.7 | 100.2 | 0.5 | 0.5 |
| 10 | T-143 | 800 | 93.6 | 94.4 | 0.3 | 0.3 |
| 11 | T-144 | 800 | 96.7 | 101.3 | 1.0 | 3.0 |

Figure 4:
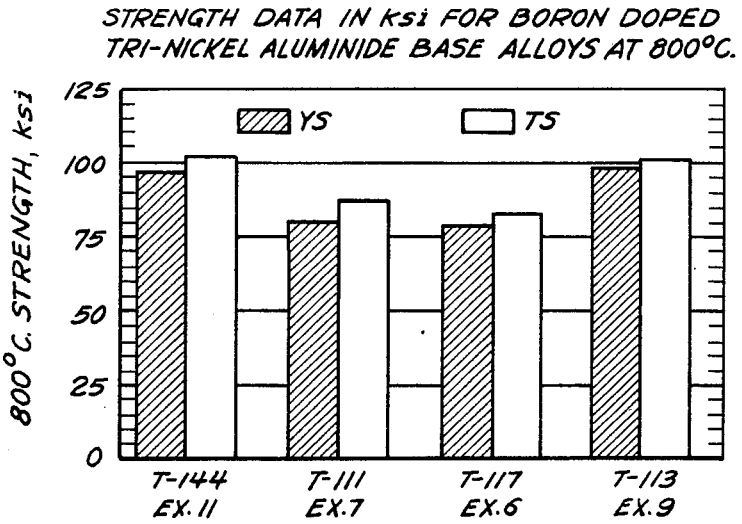
FIG. 4 is a graph in which the values for yield strength and tensile strength are plotted for various alloy compositions.
Figure 5:
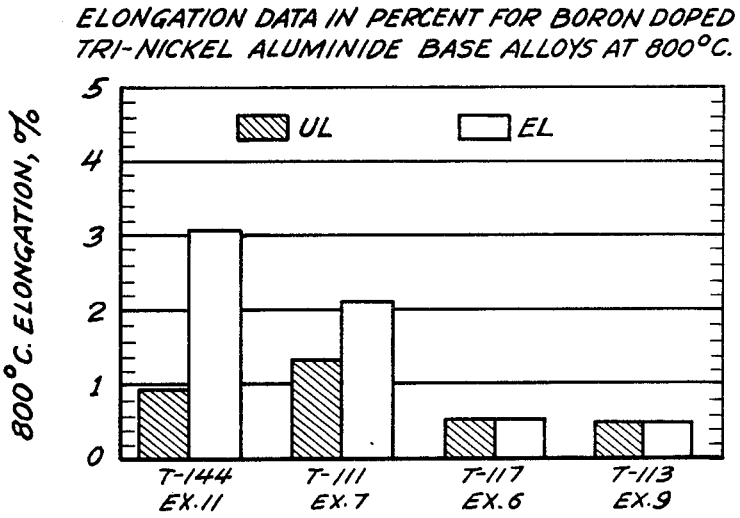
FIG. 5 is a similar graph in which other values for properties are plotted for the same alloy compositions.

In FIG. 4, the tensile data of the four alloys specifically the alloys of Examples 11, 7, 6 and 9 are shown graphically. The yield strength is shown by hatched bars and the tensile strength is shown by unhatched bars.

The room temperature tensile data for the samples of Examples 1 through 11 was measured. The data is listed in Table II. All of the data listed is for tensile tests made at room temperature of samples in the as-HIPped condition.

The elongation of this group of samples varies from 10% to 45% while the yield strength ranges from 43 ksi to 79 ksi.

Figure 3:
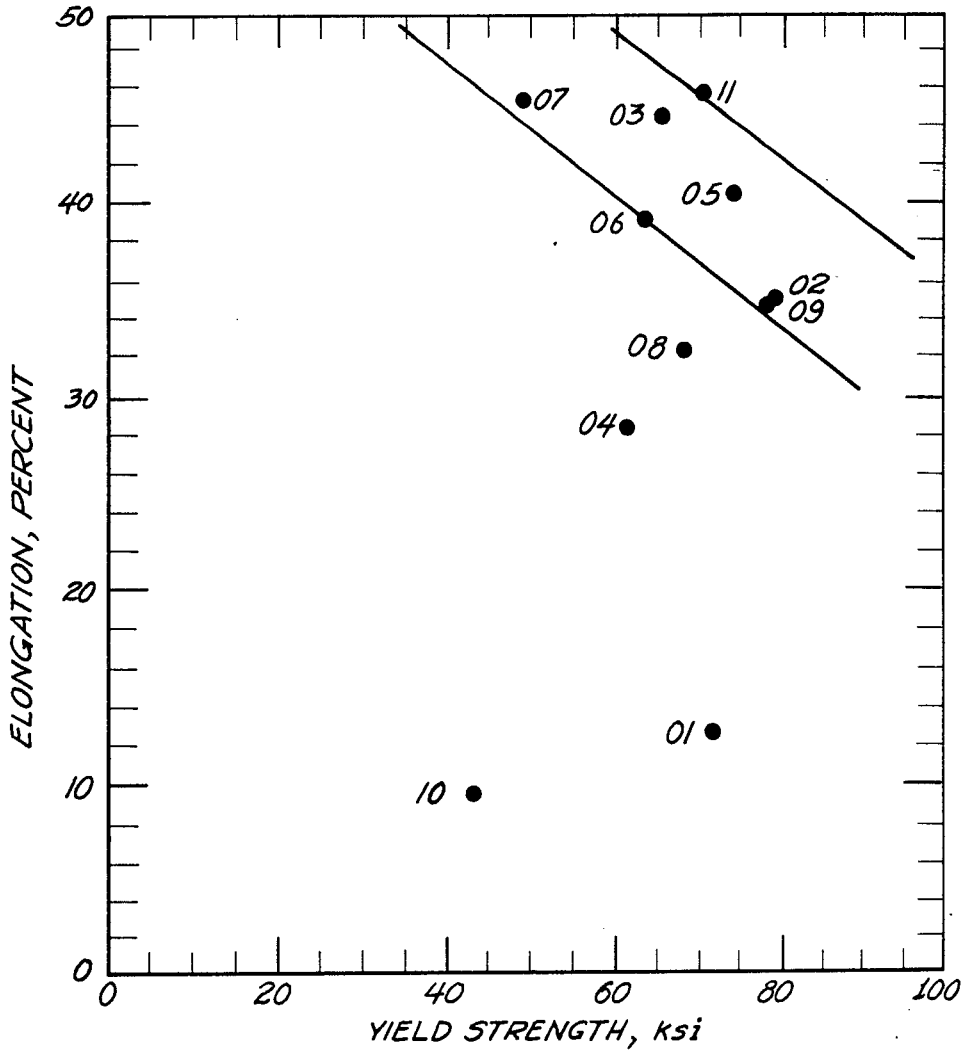
FIG. 3 is a graph in which room temperature elongation in percent is plotted as ordinate against room temperature yield strength as abscissa.

In order to provide a scheme of comparison by which the combination of both elongation and yield strength can be judged the data which is listed in Table II for the elongation and yield strength is plotted in FIG. 3. In this figure, room temperature elongation in percent is plotted as ordinate against the room temperature yield strength in ksi plotted as the abscissa. The plot shows the relative position of all samples of the eleven examples of Table II relative to each other in displaying the combined influence of yield strength and elongation.

A diagonal line has been drawn at a point where it is evident that the set of eleven alloys can be divided into two groups. The alloys with the excellent combined ductility and strength are the samples of Examples 11, 3, 5, 7, 6, 9, and 2. Within this group the ductility increases with decreasing yield strength as is evidenced by the band lying between the two diagonal lines. This band represents a desired set of room temperature material characteristics of the compositions of the present invention.

The remaining four alloys are located outside of the "excellent" band in this display of the strength-ductility relationship of this set of alloys.

From the discussion above of the ductility of these alloys at the intermediate temperatures it is further evident that not all alloys with excellent lower temperature ductility have desirable ductility properties at intermediate temperatures of 600° to 800° C.

It is of interest to relate the strength-elongation properties of the various samples according to their alloying content. For example, with reference to sample T-111 (Example 7) in comparison with sample T-114 (Example 8), hereafter Example 8, it is evident that the sample of Example 7 has a preferred set of properties and a set which is superior to those of Example 8 as illustrated on the graph of FIG. 3.

By comparing the results listed for the 800° C. tensile test of Table III it is evident that Example 8 fails in comparison to Example 7 inasmuch as the uniform elongation and also the final elongation for Example 8 is 0.0 and that this compares quite unfavorably to the uniform elongation and final elongation of Example 7. These latter values are respectively 1.3% and 2.1% as previously discussed.

Turning back now to Table I it is evident also that the major difference between the constituents of Example 7 relative to Example 8 is that Example 7 has a boron content of 0.24 whereas Example 8 has a boron content of 0.71. Accordingly the boron content of Example 8 is almost three times higher than that of boron content of Example 7.

The cobalt concentration of Example 8 is slightly higher than that of Example 7 but only by a slight margin of less than 10%.

A second criteria for compositions of the present invention, in order for them to have a highly favorable combination of properties both at the ambient temperature and at intermediate temperatures, is the presence of an appreciable level, x, of cobalt in the range of 0.05 to 0.20 in the expression:

$$[Ni_{1-x-y}Co_x(Al_{1-u-v}Q_uR_v)_y]_{100-a-b}M_aB_b$$

and preferably of the order of 0.075 to 0.15: as described above and as further discussed below.

With reference now again to the Tables, it is evident that in Table I the compositions of Examples 1, 3 and 10 are devoid of cobalt. The room temperature elongation strength comparison of FIG. 3 shows that Example 10 is the worst composition from the point of view of combination of elongation and strength and that Example 1 is next to the worst composition at this lower temperature.

In addition for Example 3 Table III contains test data establishing that at 800° C. the Example 3 sample has 0.0% uniform elongation and also 0.0% final elongation. Accordingly the composite criteria, that is, the combinations of criteria of tests at room temperature and also tests at 800° C. confirms that the sample of Example 3 does not have a useful set of properties for use at all temperatures. From this it is concluded that it is desirable and necessary in the practice of the present invention to have a cobalt content in an alloy in the range of about 0.05 to about 0.20, and preferably between about 0.075 and 0.15 for those materials which are to be used without further processing at 800° C.

Of the alloy samples, the combined properties within the "excellent" band of combined elongation and yield strength at room temperature, the samples of Examples 2, 3 and 5 have poor and insufficient tensile properties at 800° C.

The distinction between compositions which have favorable sets of properties, including the combination of alloying elements which give rise to such properties, and those compositions which do not, is made clear from a number of considerations. One such consideration is discussed with reference to composition of Example 5. As is evident from Table I Example 5 contains seven alloying elements. It contains about 10% cobalt, about 5% silicon, about 0.3% niobium, 0.03% zirconium and 0.24% boron. The tensile data at room temperature is quite good as is evident from FIG. 3. However, the tensile properties at 800° C. which are listed in Table III show that the sample has inadequate properties at this temperature.

One conclusion is that what is desirable in an alloy composition which overcomes the hot-short phenomena, in addition to the cobalt substituent, is a certain level of microalloying additive. The level, v, of microalloying additive needed in the above expression is about 0.02 to about 0.08. The alloy of Example 5 had two microalloying additives, niobium and zirconium but taken together the sum of the values of the concentrations of these elements was about 0.3, from Table III, and this, is equivalent to a value for v in the above expression of 0.013. This sum total of concentration of microalloying additives in the above expression is below the minimum of 0.020 and the combination of properties for the sample of Example 5 are found to be deficient and inadequate. It was accordingly deficient in microalloying additive.

The presence of the microalloying additive at the indicated minimum level of 0.020 in the above expression and discussion is mandatory. The additive may be one or a number of microalloying elements but the total amount must remain in the range of about 0.02 to about 0.08. The elements which may serve as microalloying elements in the practice of the present invention are as follows:

niobium, hafnium, vanadium, molybdenum, magnesium, manganese and zirconium.

There is no limit on the number of the above microalloying elements which may be employed by being included in the alloy compositions of this invention nor on the proportions in which they are included. However, the quantity present, regardless of the elements included, must be between about 0.02 and 0.08.

A preferred range is between 0.04 and 0.06.

A second conclusion is that an advantage is gained by incorporation of a macroalloying additive. A macroalloying additive is illustrated by the silicon additive of Example 6 as listed in Table I. As is evident from Table I, 9.13 atomic percent silicon macroalloying additive were included with 0.50 atomic percent of vanadium microalloying additive to produce a boron doped cobalt containing tri-nickel aluminide of superior properties in all temperature ranges including the hot-short temperature range of about 600° C. to 800° C.

A macroalloying additive is an optional additive in the compositions of the present invention. In this regard, the alloy composition of the alloy of Example 11 contained no macroalloying additive at all but was nevertheless an outstanding alloy composition.

If one or more macroalloying additive, such as the silicon of Example 6, is present at all as a macroalloying additive, it or they may be present in an amount from 0.0 to a value for the expression above which is indicated in the Table IV below. The macroalloying additive may include any one or more of the following additives in the concentration ranges shown:

TABLE IV

| Ingredient | Concentration Component of u |
|---|---|
| silicon | 0.0–0.4 |
| niobium | 0.0–0.28 |
| vanadium | 0.0–0.2 |
| tantalum | 0.0–0.2 |
| titanium | 0.0–0.2 |

These macroalloying additives may be present as macroalloying elements in any proportions but the total concentration, u, of the macroalloying elements, when taken together may not be more than about 0.40 in the above expression.

A further criteria which has been established is that no element may be present as both a microalloying additive and as a macroalloying additive. If an element may serve as either a microalloying additive or as a macroalloying additive, its presence should be measured first against the microalloying criteria and if it fits those criteria it may be considered a microalloying additive. For example, the sum total of microalloying elements present is represented by the symbol, v, in the expression above. The value of v in the expression may be between 0.02 and 0.08. Accordingly, if only one microalloying element is present then it must be present at a value of at least 0.02 but not at a concentration value in excess of 0.08.

If more than one microalloying element is present then the sum total of the concentrations of all of the microalloying elements present must be at least 0.02 but may not be more than 0.08 in the same expression.

To reiterate, the relations of the various ingredients and their relative concentrations are given by the following expression and parameter outline:

$$[Ni_{1-x-y}Co_x(Al_{1-u-v}Q_uR_v)_y]_{100-a-b}M_aB_b$$

wherein:

Q is at least one optional macroalloying element selected from the group consisting of silicon, niobium, vanadium, tantalum, and titanium; and u is the sum of the concentrations in which the macroalloying elements are present, R is at least one microalloying element selected from the group consisting of niobium, hafnium, vanadium, magnesium, manganese, molybdenum and zirconium; and v is the sum of the concentrations of all of the microalloying elements present with the proviso that if niobium or vanadium is present in a concentration in excess of 0.080 it is present as a macroalloying element, M is at least one optional fungible alloying element selected from the group consisting of iron and chromium; and the quantity, a, is the sum of the concentration between 0.0 and 15 atomic percent in which the fungible alloying elements are present, said base alloy containing the following ingredients in the following approximate concentration values for the above expression as follows:

| Ingredient | Concentration | Value |
|---|---|---|
| nickel | 1-x-y | 0.555–0.72 |
| cobalt | x | 0.05–0.20 |
| aluminum | 1-u-v | 0.52–0.98 |
| at least one microalloying element | v | 0.02–0.08 |
| at least one optional macroalloying element | u | 0.0–0.40 |
| the combination of aluminum and its substituents | y | 0.23–0.245 |

said optional macroalloying element, Q, being selected from the group and concentration as follows:

| Element | Concentration component of u |
|---|---|
| silicon | 0–0.4 |
| niobium | 0–0.28 |
| vanadium | 0–0.2 |
| tantalum | 0–0.2 |
| titanium | 0–0.2 |

said aluminide base alloy containing boron, B, in an amount, b, between 0.15 and 0.65 atomic percent.

A set of preferred ranges for the parameters of the above expression is as follows:

| Ingredient | Concentration | Value |
|---|---|---|
| nickel | 1-x-y | 0.605–0.69 |
| cobalt | x | 0.075–0.15 |
| aluminum | 1-u-v | 0.69–0.96 |
| at least one microalloying element | v | 0.04–0.06 |
| at least one optional macroalloying element | u | 0.0–0.25 |
| the combination of aluminum and its substituents | y | 0.235–0.245 |

The preferred component concentration ranges for macroalloying elements, Q, to give a total concentration, V, of the macroalloying elements is as follows:

| Element | Component Concentration |
|---|---|
| silicon | 0.0–0.2 |
| niobium | 0.0–0.2 |
| vanadium | 0.0–0.15 |
| tantalum | 0.0–0.15 |

-continued

| Element | Component Concentration |
|---|---|
| titanium | 0.0–0.15 |

Boron concentration is preferably between about 0.15 and 0.65.

In the practice of the method of the present invention a melt of the composition as described is prepared. It is then atomized to radidly solidify the composition and form particles having $Ll_2$ type crystal structure as a principal phase.

A consolidated body is then prepared to preserve the $Ll_2$ crystal structure as the principal phase. The consolidated body may be formed after allowing individual powder particles to form. These particles may then be collected and used to form the consolidated body. The consolidation may be by HIPping as described above.

Alternatively the consolidation may be by plasma spray deposition and preferably by low pressure plasma spray deposition.

As a further alternative a consolidated body may be prepared by spray forming. One method of spray forming is according to the teachings of U.S. Pat. Nos. 3,826,301 and 3,909,921. Other processes may be used as well. These methods involve atomizing a melt to form a stream and intercepting the stream of atomized melt to deposit atomized particles, and to rapidly solidify them, onto a cooled receiving surface to form a consolidated body.

Such bodies do not have to be mechanically worked to be capable of withstanding the tendency of tri-nickel aluminides to lose ductility and to undergo a hot-short condition in the intermediate temperature range of 600° to 800° C.

What is claimed and sought to be protected by Letters Patent of the United States is as follows:

1. A process for preparing a tri-nickel aluminide base alloy having good ductility at intermediate temperatures which comprises providing a melt of an alloy of the following composition $$[Ni_{1-x-y}Co_x(Al_{1-u-v}Q_uR_v)_y]_{100-a-b}M_aB_b$$

wherein:

Q is at least one optional macroalloying element selected from the group consisting of silicon, niobium, vanadium, tantalum, and titanium; and u is the sum of the concentrations in which the macroalloying elements are present, R is at least one microalloying element selected from the group consisting of niobium, hafnium, vanadium, magnesium, manganese, molybdenum and zirconium; and v is the sum of the concentrations of all of the microalloying elements present with the proviso that if niobium or vanadium is present in a concentration in excess of 0.08 it is present as a macroalloying element, M is at least one optional fungible alloying element selected from the group consisting of iron and chromium; and the quantity, a, is the sum of the concentration between 0.0 and 15 atomic percent in which the fungible alloying elements are present, said base alloy containing the following ingredients in the following approximate concentration values for the above expression as follows:

| Ingredient | Concentration | Value |
|---|---|---|
| nickel | 1-x-y | 0.555–0.72 |
| cobalt | x | 0.05–0.20 |
| aluminum | 1-u-v | 0.52–0.98 |
| at least one microalloying element | v | 0.02–0.08 |
| at least one optional macroalloying element | u | 0.0–0.40 |
| the combination of aluminum and its substituents | y | 0.23–0.245 |

said optional macroalloying element, Q, being selected from the group and concentrations as follows:

| Element | Concentration component of u |
|---|---|
| silicon | 0–0.4 |
| niobium | 0–0.28 |
| vanadium | 0–0.2 |
| tantalum | 0–0.2 |
| titanium | 0–0.2 |

said aluminide base alloy containing boron, B, in an amount, b, between 0.15 and 0.65 atomic percent, rapidly solidifying the melt by atomization and forming a body having a $Ll_2$ type crystal structure as a principal phase.

2. The process of claim 1 in which x is between 0.075 and 0.15.

3. The process of claim 1 in which 1-u-v is between 0.69 and 0.96.

4. The process of claim 1 in which b is between 0.2 and 0.5.

5. The process of claim 1 in which u is between 0.0 and 0.25.

6. The process of claim 1 in which y is between 0.235 and 0.245.

7. The method of claim 1 in which the minimum number of microalloying elements is two.

8. The method of claim 1 in which the minimum number of microalloying elements is three.

9. A body of rapidly solidified alloy having $Ll_2$ type crystal structure said body being made up of the following ingredients in atomic percent:

| | |
|---|---|
| Nickel | Balance |
| Cobalt | 10.24 |
| Aluminum | 22.35 |
| Niobium | 0.28 |
| Hafnium | 0.51 |
| Molybdenum | 0.55 |
| Zirconium | 0.03 |
| Boron | 0.24 |

and the total concentration of aluminum and its substituents being 23. atomic percent.

* * * * *